US006640985B1

(12) United States Patent
Cheng

(10) Patent No.: US 6,640,985 B1
(45) Date of Patent: Nov. 4, 2003

(54) HANGING RACK FOR TOYS

(76) Inventor: Pao-Hsien Cheng, No. 139, Jen Yi 1st Street, Jen Te Hsiang, Tainan Hsien (TW)

( * ) Notice: Subject to any disclaimer, the term of this patent is extended or adjusted under 35 U.S.C. 154(b) by 0 days.

(21) Appl. No.: 10/139,228

(22) Filed: May 7, 2002

(51) Int. Cl.[7] ..... A47F 5/08
(52) U.S. Cl. ..... 211/118
(58) Field of Search ..... 211/118, 113, 211/119.011; 446/442; D21/476; 248/102

(56) References Cited

U.S. PATENT DOCUMENTS 1,826,810 A * 10/1931 Morishita ..... 248/102
2,282,881 A * 5/1942 Ostrow ..... 446/227
3,978,610 A * 9/1976 Stubbmann ..... 446/227
D374,692 S * 10/1996 Stroud et al. ..... D21/476

* cited by examiner

*Primary Examiner*—Alvin Chin-Shue
*Assistant Examiner*—Sarah Purol
(74) *Attorney, Agent, or Firm*—Rosenberg Klein & Lee

(57) ABSTRACT

A hanging rack for toys includes two rods, and two clipping members. The rods are pivoted to a middle element at inner ends, and connected to a respective one of the clipping members at outer ends. Toys are hung on the rods, and the clipping members detachably clip onto a frame of a baby stroller or game bed for babies in the stroller or game bed to play with the toys. Having the clipping members, the hanging rack can be detached from the frame for replacement of toys to become easy or when the hanging rack is not used. The hanging rack can be folded for storage due to the pivotal connection of the rods.

3 Claims, 8 Drawing Sheets

HANGING RACK FOR TOYS

BACKGROUND OF THE INVENTION

The present invention relates to a hanging rack for toys, more particularly a hanging rack, which is fitted to the transverse rods of the frame of a baby stroller or game bed for hanging toys on, and which can be easily detached from the frame for easy replacement of toys, and can be folded for easy storage.

Referring to FIG. 10, a game bed is provided for babies to sleep in or play in that has a square frame, and a surrounding protective net. Conventionally, toys are put in the game bed for the babies to play with. However, the babies are likely to press against these toys to feel very uncomfortable, or even get hurt with these toys when they put the toys aside. To overcome this disadvantage, a toy set was provided which has several toys all connected to a supporting member thereof; the supporting member is connected to the frame of a game bed, and is movable only within a very small range but can't be detached. Consequently, the toys set can't be replaced with new ones when the baby is tired of it. Furthermore, little babies who can't stand can't play with such toy set because the toy set is disposed at such a height that the baby can't reach it while sitting in the bed.

SUMMARY OF THE INVENTION

It is a main object of the present invention to provide a hanging rack for toys, which is detachably fitted to the transverse rods of the frame of a baby stroller or game bed for hanging toys on, and which can be folded for easy storage.

It is another object of the present invention to provide the toy hanging rack in such a form that the same can't possibly clip onto hands of the user when it is folded.

The hanging rack for toys of the present invention includes two rods, and two clipping members. The rods are pivoted to respective ends of a middle pivotal element at inner ends, and connected to a respective one of the clipping members at outer ends thereof. The rods are provided for hanging toys on. The clipping members detachably clip onto the frame of a baby stroller or game bed for babies in the bed or stroller to play with the toys hung on the rods. Having the clipping members, the hanging rack can be detached from the frame for allowing replacement of toys to become easy. The hanging rack can be folded for easy storage by means of pivoting the rods close to each other.

The pivotal element is provided with such a length that it can prevent the inner ends of the rods from moving too close to each other when the hanging rack is being folded, thus preventing a user's fingers from being clipped and hurt by the inner ends.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
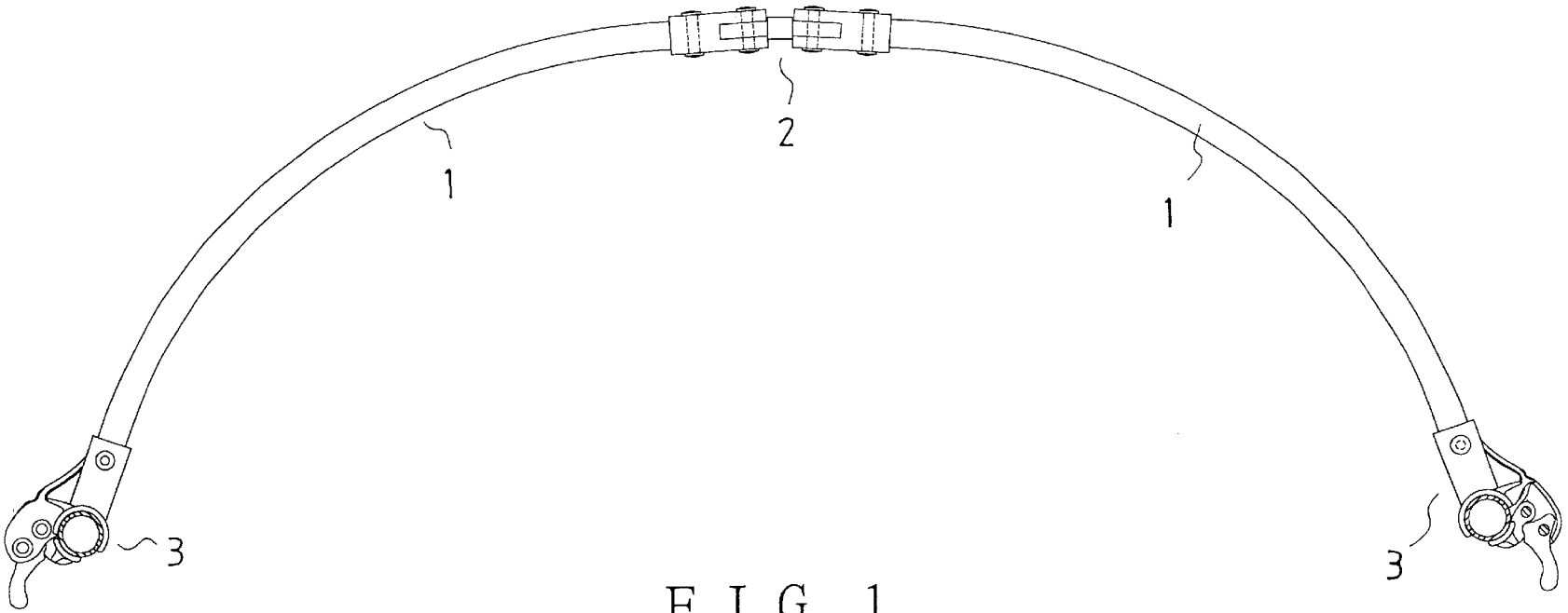
FIG. 1 is a front view of the hanging rack for toys according to the present invention.
Figure 2:
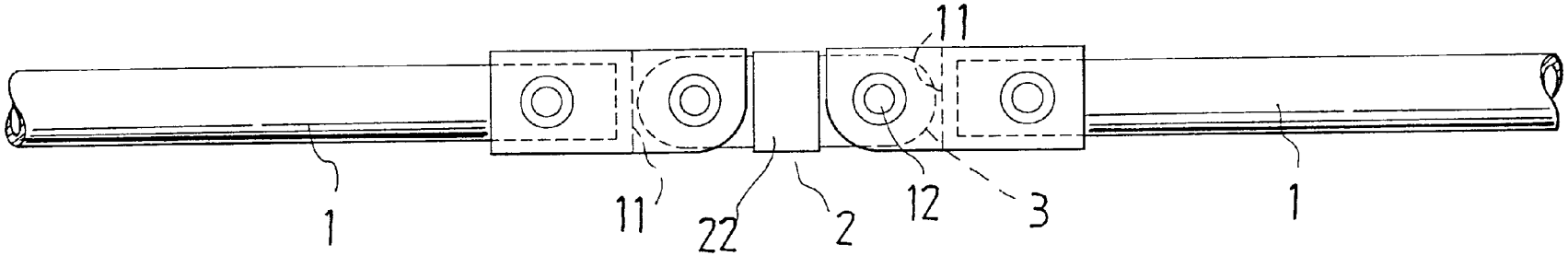
FIG. 2 is a partial view of the hanging rack of the present invention.
Figure 3:
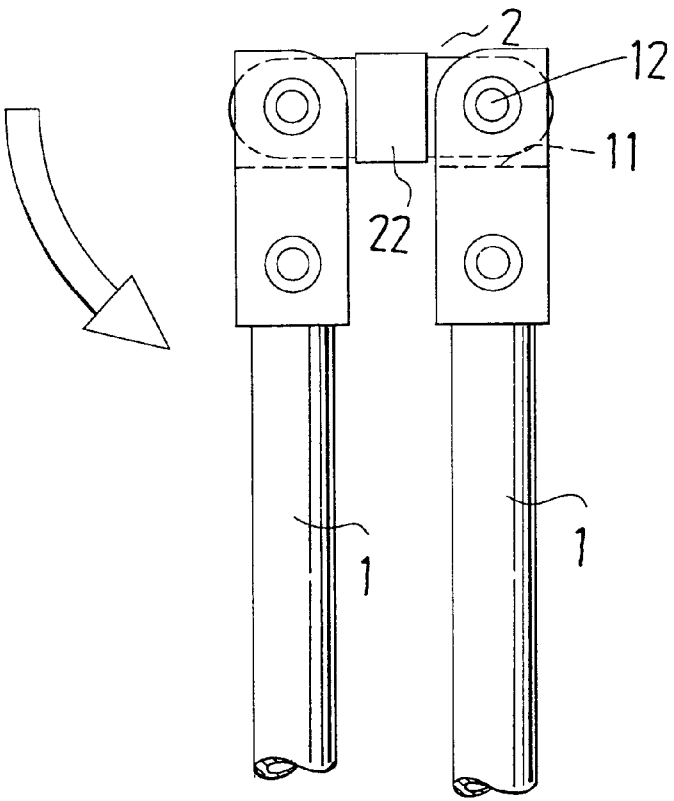
FIG. 3 is a partial view of the hanging rack of the present invention in the folded position.
Figure 4:
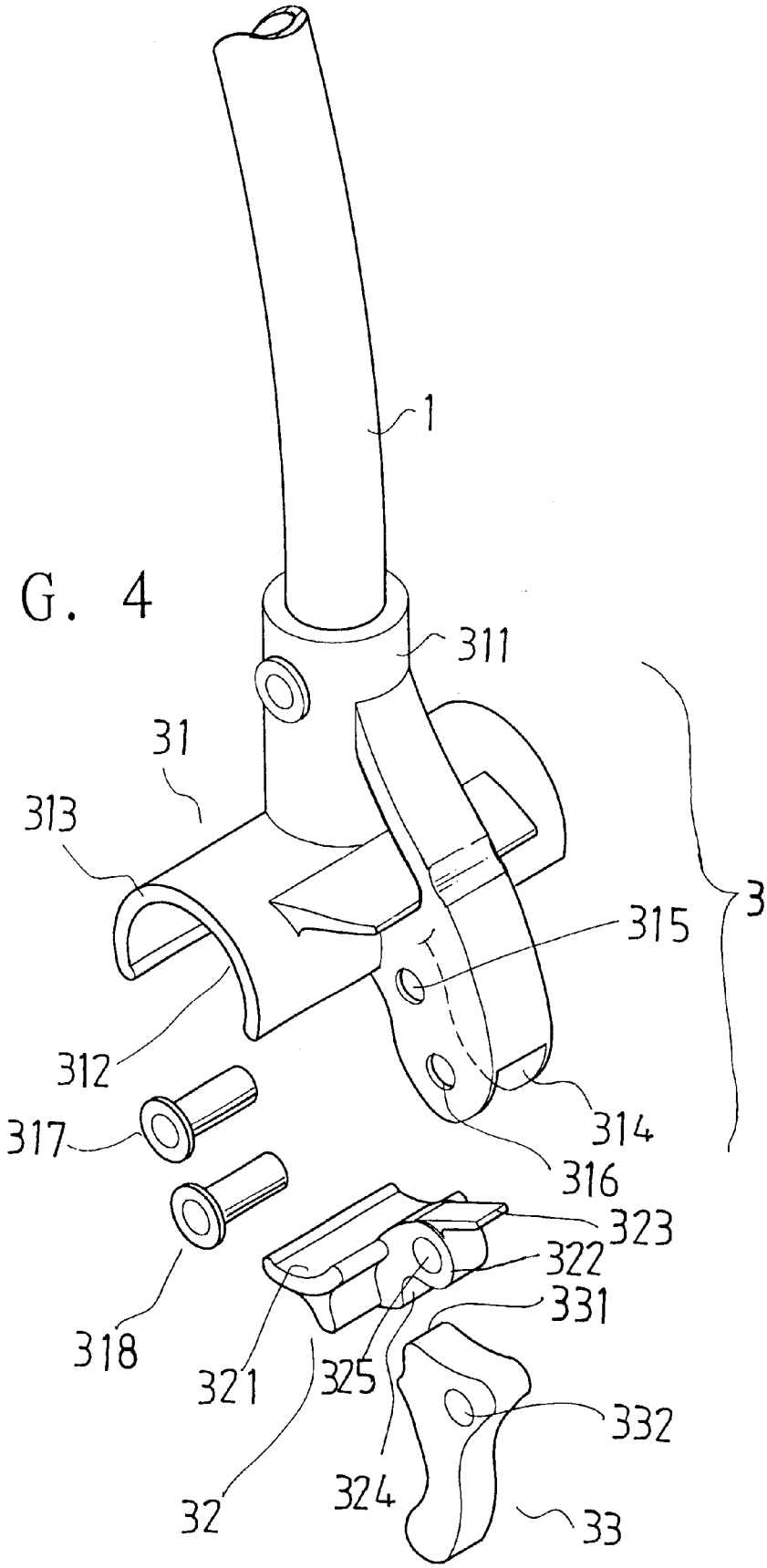
FIG. 4 is exploded perspective view of the clipping member according to the present invention.
Figure 5:
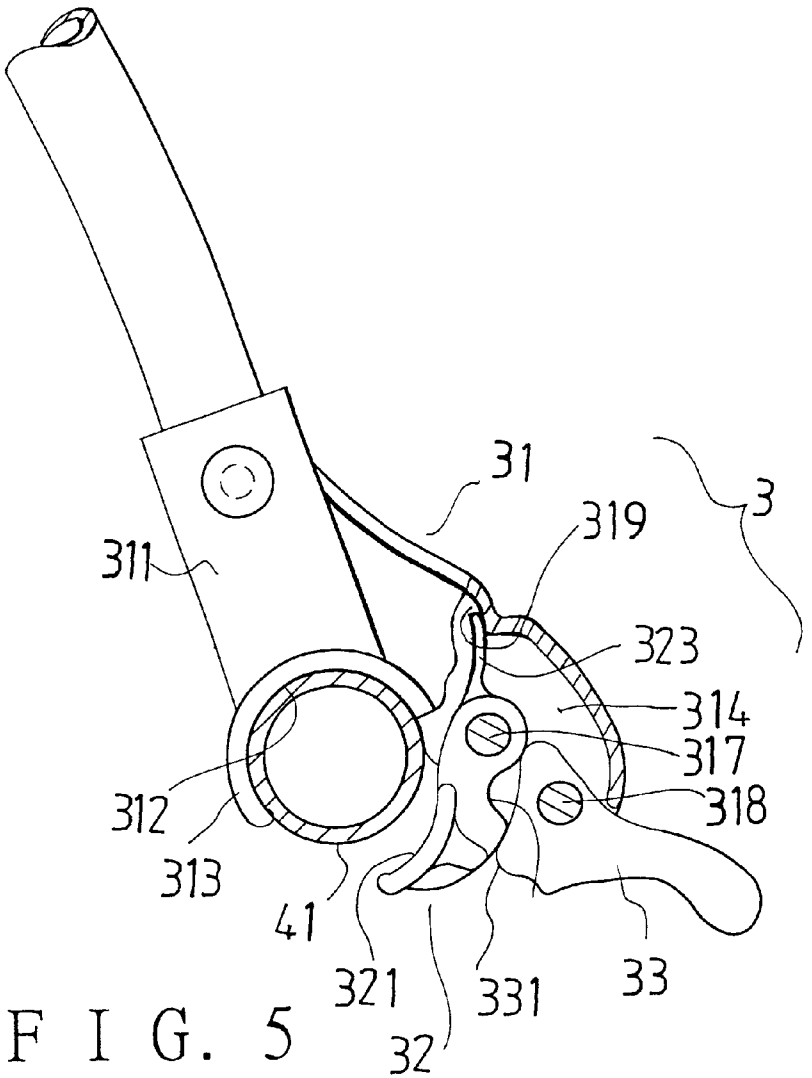
FIG. 5 is a view of the clipping member of the present invention in the unlocking position.
Figure 6:
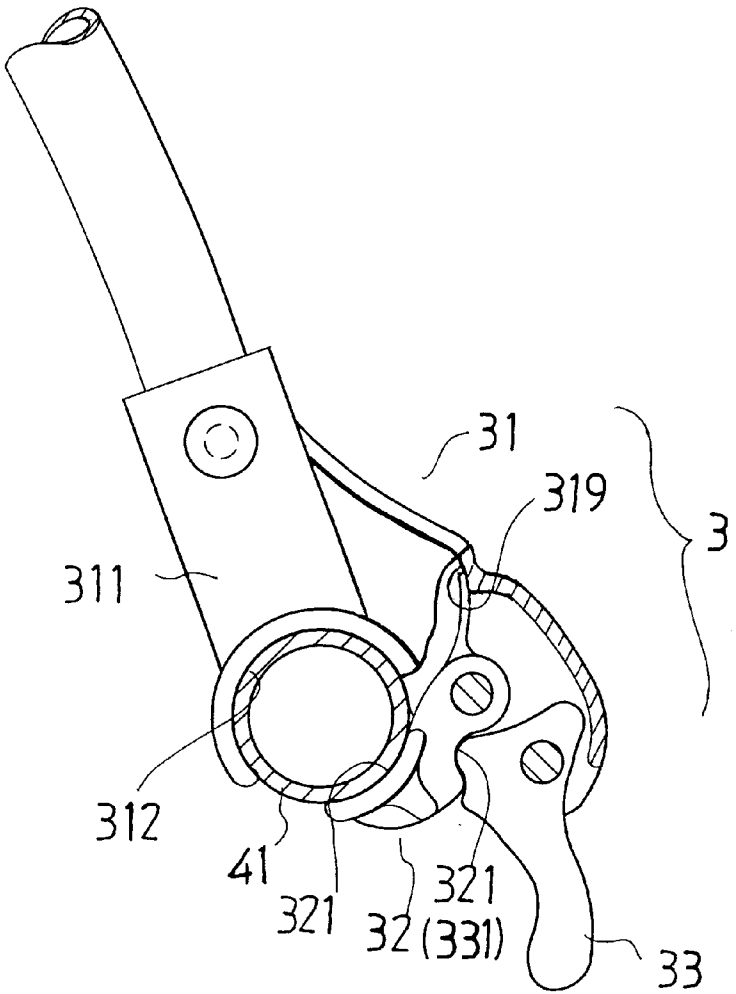
FIG. 6 is a view of the clipping member of the present invention in the locking position.

Referring to FIG. 1, a hanging rack for toys of the present invention includes a hanging rod, a pivotal member 2, and two clipping members 3.

The hanging rod has two rod parts 1,1. The rod parts 1 can be made to a curved shape. The rod parts 1,1 each has both a hollow 11 and a lateral opening at an inner end thereof The inner ends of the rod parts 1,1 are pivoted to a respective one of two ends 21,21 of the pivotal member 2 by means of pivotal bolts 12 with the ends of the pivotal member 2 being received in the hollows 11. Thus, the hanging rod can be folded into a shorter length when the hanging rack is not used. Furthermore, the pivotal member 2 is provided with a middle block 22 between two ends thereof for providing a space to the inner ends of the rod parts 1,1 when the hanging rod is folded.

The clipping members 3 each includes a main body 31, a lower fastening part 32, and a lever 33. The main body 31 is fixedly connected to an outer end of a respective one of the rod parts 1, 1 from a connecting tube 311 thereof. The main body 31 has a connecting portion having a receiving room 314 therein, and is provided with upper aligned through holes 315, and lower aligned through holes 316 on two lateral walls of the connecting portion. The connecting portion further has an engaging hole 319 at the upper end of the receiving room 314. The main body 31 is provided with an upper fastening part 313, which is connected to the connecting tube 311, and perpendicular to the same, and has a concavely curved lower side 312.

The lower fastening part 32 has a concavely curved upper side 321, and is pivoted to the upper through holes 315 of the connecting portion from a holed connecting portion 322 thereof by means of a first pivotal pin 317 with the curved upper side 321 facing the curved lower side 312 of the main body 31. The lower fastening part 32 further has an engaging curved recess 324 on a lower side, and an elastic plate 323 extending opposite to the curved upper side 321 from the connecting portion 322; the elastic plate 323 is inserted into the engaging hole 319 of the main body 31 for biasing the curved upper side 321 of the lower fastening part 32 downwards.

The lever 33 has an engaging end 331, and is pivoted to the lower through holes 316 of the connecting portion of the main body 31 at a middle portion thereof by means of a second pivotal pin 318 such that the engaging end 331 can engage the engaging curved recess 324 to fix the lower fastening part 32 in a locking position; the concavely curved upper side 321 of the lower fastening part 32 defines a cylindrical room together with the curved lower side 312 of the main body 31 when the lower fastening part 32 is in the locking position.

Figure 7:
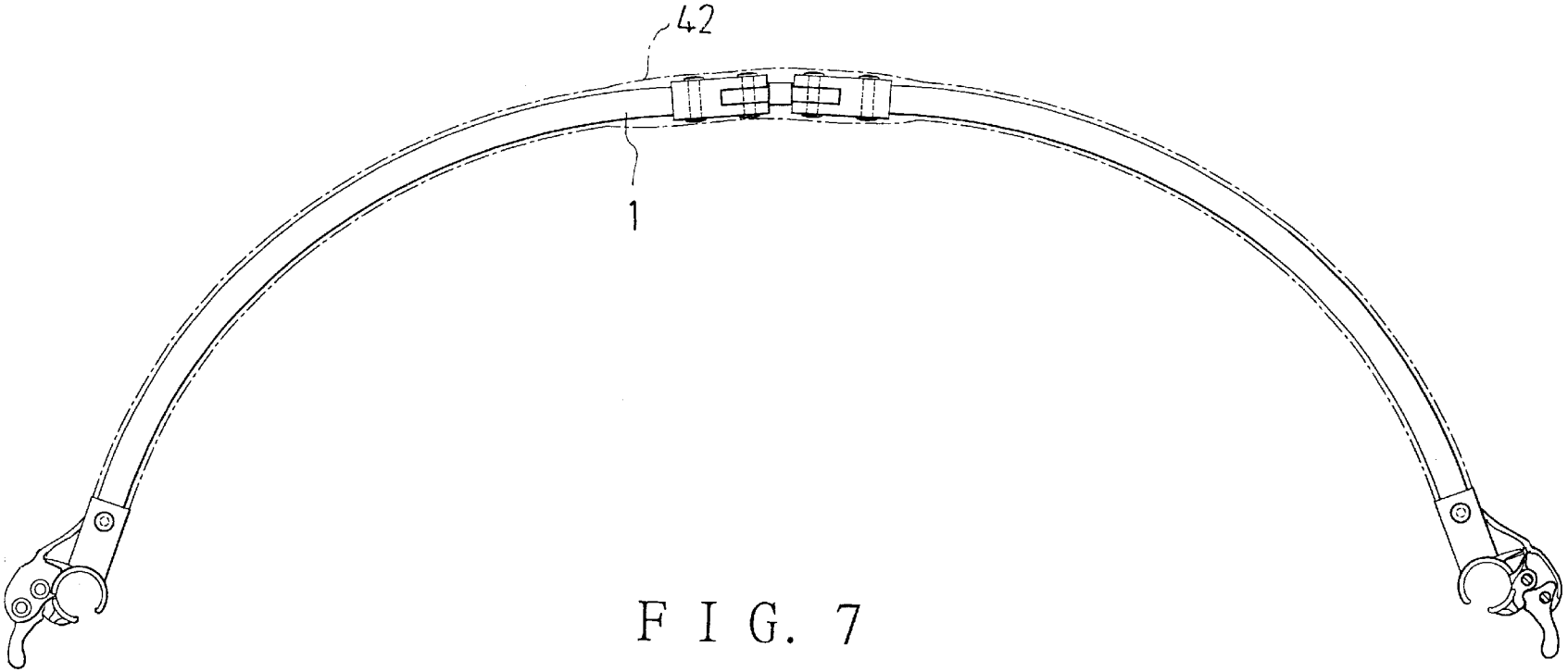
FIG. 7 is a view of the rod part having a protective cover of the present invention.

Thus, referring to FIG. 7, the hanging rack can be secured to a baby stroller or game bed frame made of cylindrical rods 41 by means of clipping the clipping members 3 onto a respective one of two opposing one of the cylindrical rods 41, and the clipping members 3 can be detached from the frame after the engaging ends 331 of the levers 33 are disengaged from the engaging curved recesses 324; the elastic plate 323 will help the curved side 321 of the lower fastening part 32 move away from the main body 31 for the clipping members 3 to be detached more easily.

Figure 8:
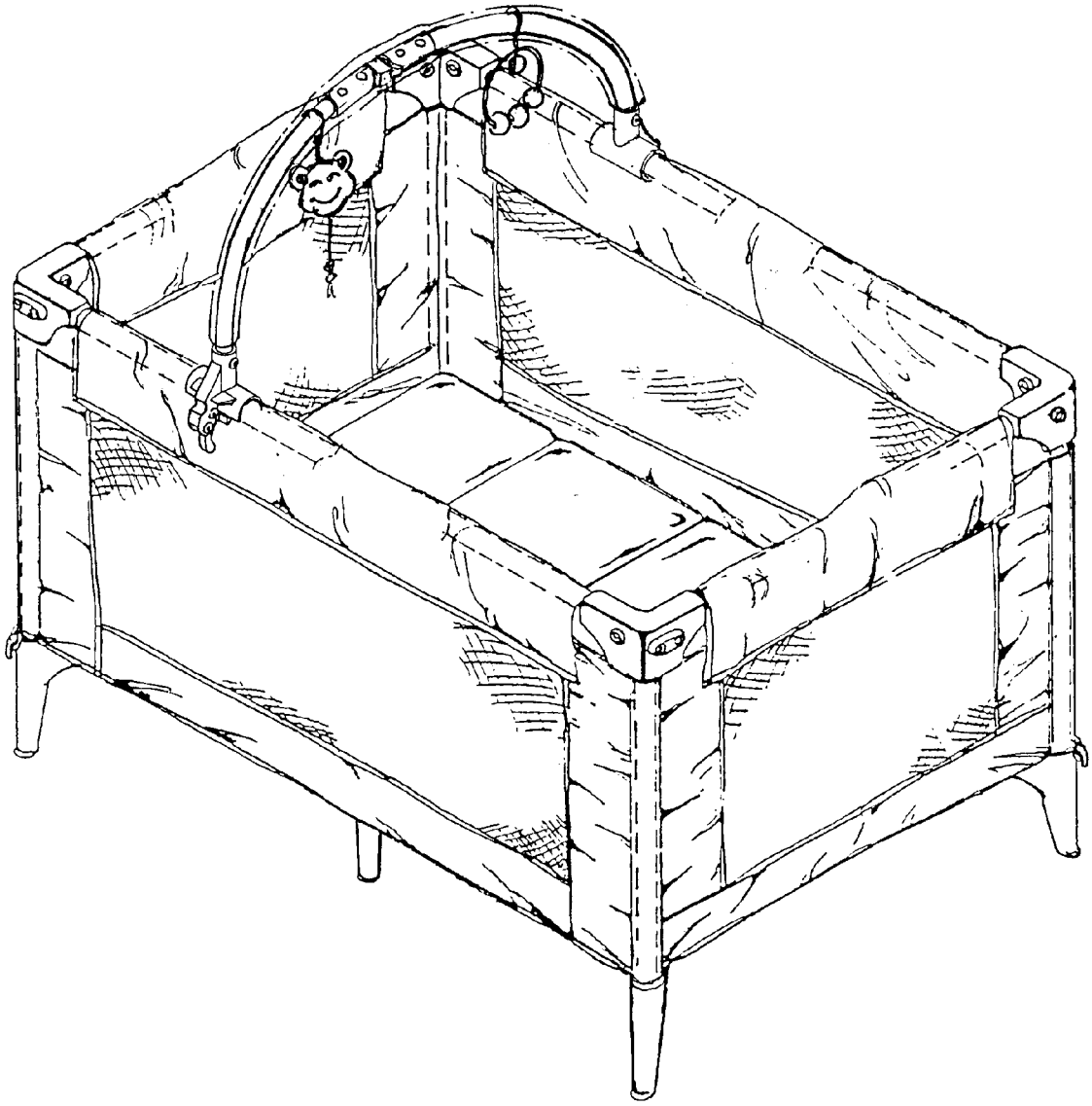
FIG. 8 is a perspective view of a baby bed.
Figure 9:
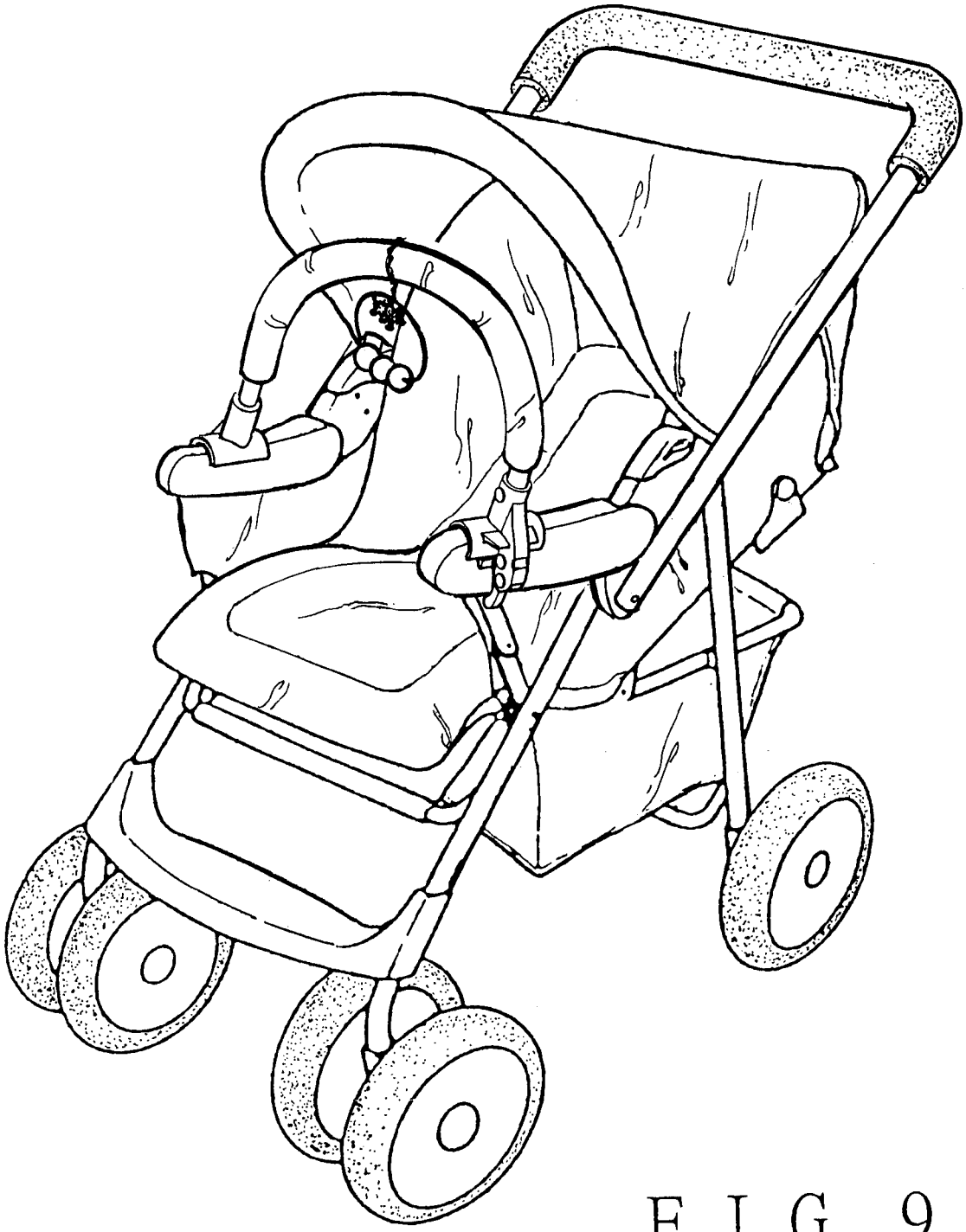
FIG. 9 is a perspective view of the stroller.
Figure 10:
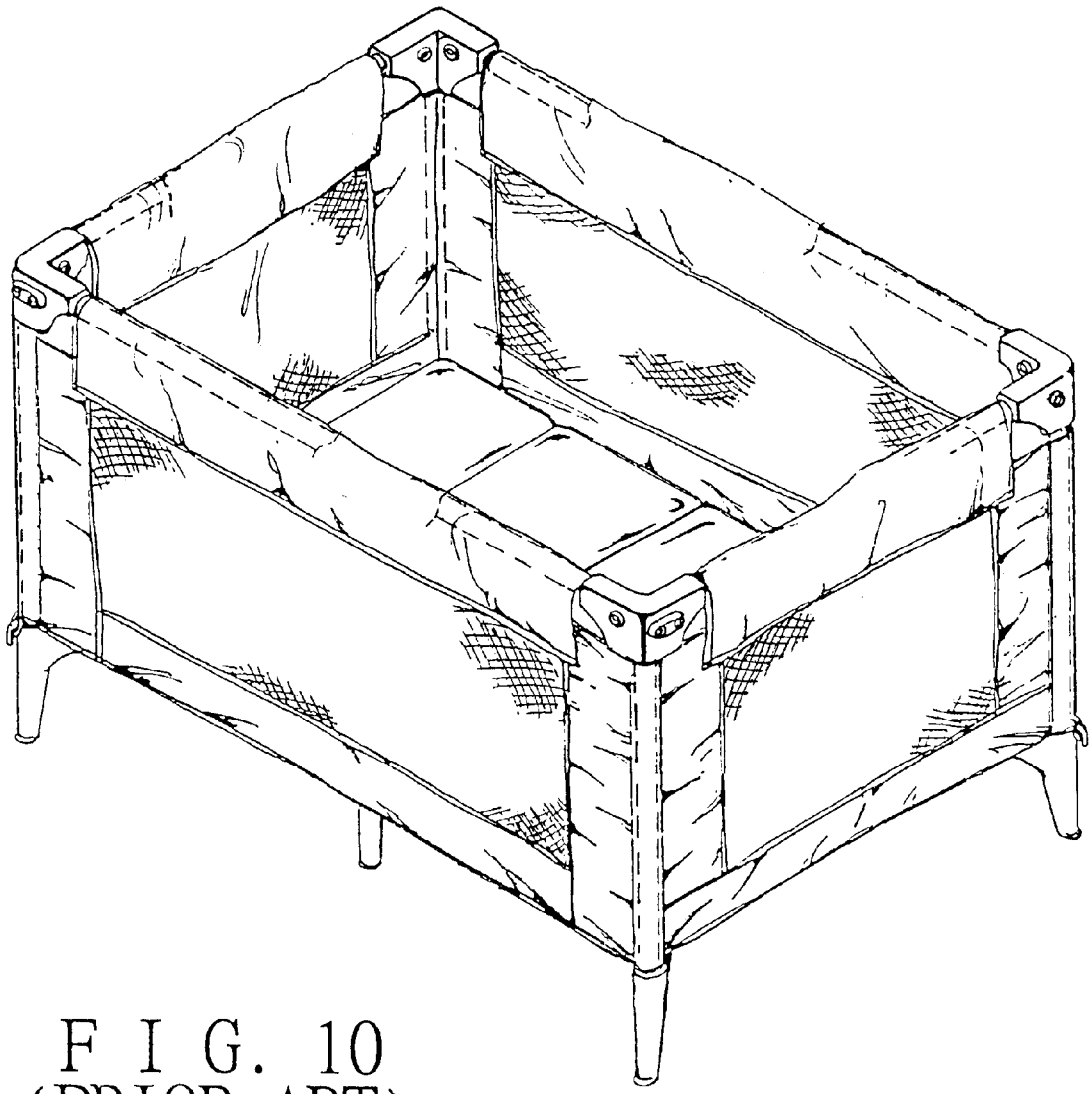
F I G. 10 (PRIOR ART)
FIG. 10 is perspective view of the prior game bed.

Referring to FIG. 7 again, the rod part I has a protective cover 42 made of soft materials with thickness. Toys can be hanged on the protective cover 42 and set on a baby stroller or game bed as FIGS. 8 and 9.

From the above description, it can be easily understood that the hanging rack of the present invention has advantages as followings:

1. When fitted to a baby stroller or game bed, the hanging rack can be adjusted in position for babies in the stroller or game bed to reach easily.
2. The clipping members can be securely connected to the frame of the baby stroller or game bed, therefore the hanging rack can't possibly fall off to hurt the babies in the stroller or game bed.
3. The middle block 22 of the pivotal member 2 can prevent the inner ends of the rod parts 1,1 of the hanging rod from moving too close to each other when the hanging rack is being folded, thus preventing a user's fingers from being clipped and hurt by the inner ends.
4. The hanging rod allows toys hung thereon to be replaced with new ones. And, the rack can be detached for replacement of toys to become easier, and is foldable into shorter length when not used.

What is claimed is:

1. A hanging rack for toys, comprising:

(1) a hanging rod having a protective cover and formed of two rod parts, the rod parts being connected together at inner ends thereof; and, (2) two clipping members, the clipping members each including (a) a main body connected to an outer end of a respective one of the rod parts of the hanging rod; the main body having an upper fastening part having a concavely curved lower side, and a connecting portion having a receiving room therein;

(b) a lower fastening part having a concavely curved upper side; the lower fastening part being pivoted to an upper portion of the connecting portion with the curved upper side facing the curved lower side of the main body; the lower fastening part having a engaging curved recess on a lower side thereof;

(c) a lever having an engaging end, the lever being pivoted to a lower portion of the connecting portion with the engaging end being capable of engaging the engaging curved recess to fix the lower fastening part in a locking position; the concavely curved upper side of the lower fastening part defining a cylindrical hole together with the curved lower side of the main body when the lower fastening part is in the locking position;

whereby the hanging rack can be secured to a baby stroller or game bed frame made of cylindrical rods for hanging toys on by means of clipping the clipping members onto a respective one of two opposing one of the cylindrical rods, and the clipping members can be detached from the frame after the levers are disengaged from the engaging curved recesses.

2. The hanging rack for toys of claim 1, wherein the inner ends of the rod parts of the hanging rod are pivoted to a respective end of a pivotal member so that the hanging rack can be folded when not used; the pivotal member having a middle block between two ends thereof for providing a space to the inner ends of the rod parts when the hanging rack is folded.

3. The hanging rack for toys of claim 1, wherein the lower fastening parts are each formed with an elastic plate opposite to the curved upper side, the elastic plate extending into an engaging hole of the connecting portion of the main body so that it can bias the curved upper side further downwards when the lever is disengaged from the engaging curved recess of the lower fastening part.

* * * * *